United States Patent [19]

Haizmann et al.

[11] Patent Number: 5,045,175

[45] **Date of Patent: * Sep. 3, 1991**

[54] SEPARATION SYSTEM FOR $C_4$ HYDROTREATER EFFLUENT HAVING REDUCED HYDROCARBON LOSS

[75] Inventors: Robert S. Haizmann, Rolling Meadows, Ill.; Andrew S. Zarchy, Amawalk; Martin F. Symoniak, Mahopac, both of N.Y.

[73] Assignee: UOP, Des Plaines, Ill.

[ * ] Notice: The portion of the term of this patent subsequent to Dec. 25, 2007 has been disclaimed.

[21] Appl. No.: 600,790

[22] Filed: Oct. 22, 1990

Related U.S. Application Data

[63] Continuation-in-part of Ser. No. 458,267, Jul. 17, 1990, Pat. No. 4,980,046.

[51] Int. Cl.[5] ..... C10G 67/06

[52] U.S. Cl. ..... 208/99; 208/100; 208/213; 208/310 Z

[58] Field of Search ..... 208/99, 100, 212, 213, 208/217, 188, 310 Z

[56] References Cited

U.S. PATENT DOCUMENTS 4,980,846 12/1990 Zarchy et al. ..... 208/99

*Primary Examiner*—Curtis R. Davis
*Assistant Examiner*—William C. Diemler
*Attorney, Agent, or Firm*—Thomas K. McBride; John G. Tolomei

[57] ABSTRACT

A hydrotreating process uses a separation section that reduces the loss of $C_4$ and higher hydrocarbons through the use of a low hydrogen to hydrocarbon ratio in the reactor and the adsorptive removal of a majority of hydrogen sulfide from a liquid phase hydrotreater effluent. Sulfurous hydrocarbon feed is admixed with hydrogen to maintain a hydrogen to hydrocarbon ratio of less than 50 SCFB. The hydrogen and hydrocarbons are passed through a hydrotreater reactor to convert sulfur compounds to $H_2S$. The hydrotreater effluent is cooled and after flashing of any excess hydrogen or light ends the cooled effluent is contacted with an adsorbent material for the removal of $H_2S$. A hydrotreated hydrocarbon product is withdrawn from the adsorption section. The low hydrogen to hydrocarbon ratio permits the process to be used without the recycle of hydrogen thereby eliminating the need for separators and compressors that were formly used to recycle hydrogen to the hydrotreater. The elimination of the recycle and the low hydrogen to hydrocarbon ratio simplifies the flowscheme which can use a simple separator to flash light ends, hydrogen and some $H_2S$ from the hydrotreater effluent. This process thus eliminates the need for a stripping section that was formerly needed to remove light ends and hydrogen sulfide from the hydrotreated product. The adsorptive removal of the $H_2S$ and the limited venting of hydrogen allows essentially all of the hydrotreated product to be preserved. In most flowschemes $H_2S$ removal can be carried out in the adsorbers that are usually present for drying of the hydrotreated feed.

17 Claims, 1 Drawing Sheet

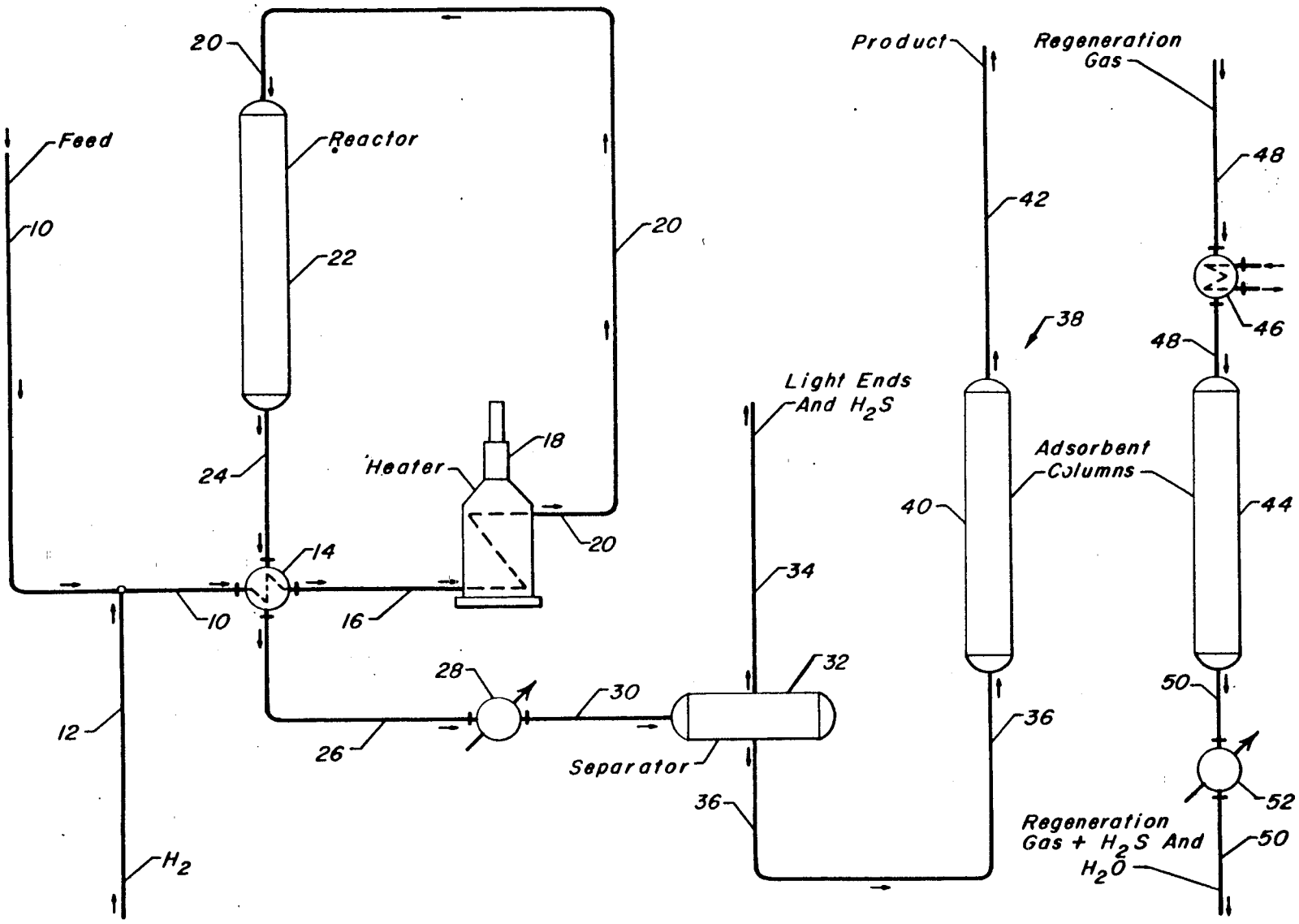
Regeneration Gas
48
46
48
44
Adsorbent Columns
50
52
50
Regeneration Gas + $H_2S$ And $H_2O$
38
42
Product
40
36
Light Ends And $H_2S$
34
32
36
Separator
30
28
26
20
20
18
Heater
16
Reactor
22
20
14
24
10
$H_2$
12
Feed
10

SEPARATION SYSTEM FOR $C_4$ HYDROTREATER EFFLUENT HAVING REDUCED HYDROCARBON LOSS

CROSS-REFERENCE TO RELATED APPLICATIONS

This application is a continuation in part of U.S. Ser. No. 458,267 which was allowed as U.S. Pat. No. 4,980,046 on July 17, 1990.

BACKGROUND OF THE INVENTION

This invention relates generally to the hydrotreatment of hydrocarbons. This invention relates more specifically to the supply of hydrogen to a hydrotreatment zone and the separation of sulfur compounds from the hydrotreater effluent.

DESCRIPTION OF THE PRIOR ART

Hydrotreatment is a common method for the upgrading of feedstocks by the removal of contaminants such as sulfur, oxygen, and nitrogen. Hydrotreatment removes contaminants from the feed that are objectionable either in the end products or will interfere with the operation of processes that are used to treat or convert the hydrocarbon feedstream. Sulfur is a particularly troublesome contaminant since it is often a poison for the catalyst in downstream processes, particularly platinum-containing catalysts, is corrosive to the process equipment and is objectionable in most hydrocarbon products. In order to eliminate the adverse catalytic effects of sulfur compounds, it is often necessary to reduce these compounds to very low levels. In isomerization, for example, sulfur concentrations of less than 0.5 ppm are needed. It is well known that organo-sulfur and organo-oxygen compounds can be removed from hydrocarbon fractions by the use of hydrotreatment. Hydrotreatment feedstocks containing organo-sulfur compounds such as mercaptans, sulfides, disulfides and thiophenes are reacted with hydrogen to produce hydrocarbons and hydrogen sulfide. It is also well known that the reaction of the organo-sulfur compounds is accelerated by the presence of catalysts comprising Group VIII metals and Group VIB metals supported on a refractory inorganic oxide. Hydrotreating also removes oxygenate compounds by converting them into lower boiling hydrocarbons and water. The hydrogen sulfide and at least a portion of the water are typically removed in a stabilizer from which a purified hydrocarbon stream is recovered.

The desulfurization and deoxygenation of the hydrocarbons in the hydrotreater is basically a hydrogenation process. In hydrogenation processes, the reaction rate is generally believed to be in proportion to the hydrogen partial pressure. As a result, conventional hydrotreating processes tend to use a fairly high hydrogen to hydrocarbon ratio.

U.S. Pat. No. 4,627,910 issued to Milman teaches the hydrotreatment of light feeds including naphtha with a catalyst comprising Group VIII metal, phosphorus and cobalt on an alumina support at hydrotreament conditions including a temperature of from 400°-950° F. and a pressure of from 20 to 6000 psig. The Milman reference also teaches that the process requires a minimum hydrogen circulation of 50 standard cubic feet per barrel (SCFB) with much higher hydrogen to hydrocarbon circulations of 400-10,000 SCFB being preferred. The need to reduce contaminants to low concentration levels has also led those skilled in the art to believe that a high hydrogen to hydrocarbon ratios are necessary in order to achieve the desired degree of contaminant removal. For example, in isomerization processes, it is not only necessary to reduce sulfur compounds to low concentrations but oxygen concentrations of less than 0.1 ppm are also sought.

Providing a high hydrogen to hydrocarbon ratio in the hydrotreatment zone complicates the arrangement of the process and presents a number of drawbacks. The use of a high hydrogen to hydrocarbon ratio adds significant cost to the operation. Typically, the high hydrogen to hydrocarbon ratio requires facilities for recovering hydrogen and returning it to the hydrotreatment reactor. When hydrogen is recycled, a recycle compressor, additional heat exchangers and extra cooling capacity are all required and add significant capital and operating expense to the process. The expense of the recycle facilities can be avoided by operating with once-through hydrogen, but at high hydrogen to hydrocarbon ratios once-through hydrogen is not economical due to high losses of hydrogen and more importantly, product that would occur without increasing the size and complexity of the product recovery facilities.

A conventional hydrotreating system will use separation facilities that include a separator, a stripper and usually an adsorption section. The adsorption section is typically used to remove water from the bottom fraction of the stripper. The separator is typically used for the recovery of hydrogen that is recycled to the hydrotreatment zone in order to supply most of the hydrogen that circulates through the hydrotreating section. The remaining portion of the hydrotreater effluent is taken from the separator in liquid phase and introduced into a stripper from which an overhead stream consisting primarily of light hydrocarbons and hydrogen sulfide gas is taken overhead to remove sulfur and light gases from the hydrotreatment zone while the remaining portion of the effluent is taken as a bottoms stream for further processing. The recycle of the entire gaseous stream, from the separator in order to recover hydrogen, forces all of the hydrogen sulfide gas to be removed with the overhead from the stripper. The high gas volume that leaves the overhead from the stripper carries valuable product hydrocarbons away in a light gas stream. Since it is uneconomical to recover such hydrocarbons from the light gas stream, they are essentially lost from the process. In addition, the high volume of hydrogen that circulates through the separator and hydrotreatment reactor increases the concentration of product hydrocarbons that are recirculated through the hydrotreatment reactor thereby resulting in a larger throughput through the reactor and loss of product hydrocarbons to side reactions such as cracking.

It is an object of this invention to reduce the loss of product hydrocarbons by the separation of light gases and sulfur compounds from the effluent of a hydrotreatment zone.

Another object of this invention is to provide a separation section for a hydrotreatment process that has less equipment and complexity than those currently in use.

Yet another object of this invention is to reduce the volumetric flow rate through a hydrotreatment reaction for a given volume of the hydrocarbons.

A further object of this invention is the elimination of recycle facilities for maintaining a high hydrogen to hydrocarbon ratio in an a hydrotreatment zone.

BRIEF DESCRIPTION OF THE INVENTION

This invention is a hydrotreatment zone and separation section that uses a low hydrogen to hydrocarbon ratio in the hydrotreatment zone thereby eliminating the need for the recycle of hydrogen and allowing sulfur compounds to be withdrawn from the hydrotreatment effluent in an adsorption zone. In the process of this invention, a sulfurous hydrogen-containing feedstream is contacted with a hydrotreatment catalyst at a low hydrogen concentration. It has been found that a high degree of sulfur conversion can be obtained at low hydrogen to hydrocarbon ratios. This degree of sulfur compound conversion allows desulfurization of the feedstock to less than the necessary 0.5 ppm level. Without the hydrogen recycle, the hydrotreatment zone operates with a hydrogen to hydrocarbon ratio of less than 50 SCFB and preferably in a range between 10 to 40 SCFB. This low addition of hydrogen permits venting of the hydrogen in the downstream separation sections without a significant loss of heavier hydrocarbons, such as butanes or pentanes, or an economic penalty in the cost of the hydrogen lost. The downstream separation relies primarily on adsorptive separation of the hydrogen sulfide produced by the conversion of the sulfur compounds in the hydrotreatment zone. In most cases, the separation facilities also include a single flash zone that separates the hydrogen from normally liquid hydrocarbons. When the flash zone is used, $H_2S$ will be removed as a gas with the hydrogen as well as in the liquid phase adsorption stream. The use of the lower hydrogen to hydrocarbon ratio is particularly advantageous in the separation section since it vents excess $H_2S$; such venting was not possible in the conventional flowscheme of the prior art since the overhead from the flash zone contained too high of a concentration of valuable hydrocarbons. However, due to the much greater liquid volume, most of the $H_2S$ is removed adsorptively. It is believed that the adsorptive separation section will cost less than the conventional stripper of the prior art. However, aside from any decreased cost associated with providing an adsorptive separation for the $H_2S$, additional product is recovered from the adsorptive separation section, product which would have been lost from the stripping section of the conventional hydrotreatment separation facilities. The additional cost of providing adsorptive separation is further minimized for many hydrotreatment arrangements that already provide an adsorptive separation for the removal of water.

Accordingly, in one embodiment, this invention is a process for treating a sulfurous hydrocarbon stream comprising $C_4$ and higher molecular weight hydrocarbons to convert sulfur compounds to $H_2S$ and reduce the sulfur concentration of the hydrocarbon stream. The process includes the steps of admixing a sulfurous hydrocarbon feedstream with a hydrogen stream to provide a hydrogen concentration in a range of from 10 to 50 SCFB. The sulfurous hydrocarbon stream and hydrogen are contacted in a hydrotreating zone with a hydrotreating catalyst at hydrotreating conditions to convert sulfur compounds to $H_2S$ and produce a hydrotreated effluent stream. The hydrotreated effluent stream is passed to a flash separator at conditions that will maintain a liquid phase containing at least 75 wt. % of the $H_2S$ and hydrogen from the hydrotreated effluent to produce an at least partially stabilized effluent. The partially stabilized effluent passes in liquid phase to an adsorption section where it is contacted with an adsorbent material selected for $H_2S$. A desulfurized hydrocarbon stream is recovered from the adsorption section.

In another embodiment, this invention is a process for treating a sulfurous hydrocarbon stream that comprises $C_4$ and higher molecular weight hydrocarbons to convert sulfur compounds to $H_2S$ and reduce the sulfur concentration of the hydrocarbon stream wherein the process includes the steps of admixing a sulfurous hydrocarbon stream with a hydrogen stream in an amount that will produce a hydrogen to hydrocarbon ratio of less than 50 SCFB. The sulfurous hydrocarbon stream and the hydrogen are contacted in a hydrotreating zone with a hydrotreating catalyst at hydrotreating conditions to convert sulfur compounds to $H_2S$ and produce a hydrotreated effluent stream. The hydrotreating zone can also convert oxygenate compounds to $H_2O$. The amount of hydrogen that is admixed with the sulfurous hydrocarbon stream is adjusted to produce a hydrogen to hydrocarbon ratio of less than 30 SCFB in the hydrotreated effluent stream. The hydrotreated effluent stream is cooled so that essentially all of the hydrogen and hydrogen sulfide is adsorbed into a liquid phase of the hydrotreated effluent stream. The cooled hydrotreated effluent stream is passed to an adsorption section and contacted with an adsorbent material selective for $H_2S$ and a desulfurized hydrocarbon stream is recovered from the adsorption section. Additional details and embodiments of this invention are disclosed in the following detailed description.

BRIEF DESCRIPTION OF THE DRAWINGS

FIG. 1 depicts a process arrangement for the process of this invention.

DETAILED DESCRIPTION OF THE INVENTION

A basic understanding of this invention can be obtained from FIG. 1 which shows a basic flowscheme for the process of this invention. The hydrocarbon feed enters the process by line 10 where it is admixed with make-up hydrogen from line 12. The combined feed and hydrogen are first heated in exchanger 14 and carried by line 16 to a heater 18 to further heat the feed and hydrogen to a reaction temperature. A line 20 carries the heated feed and hydrogen to a hydrotreater reactor 22 from which the hydrotreated effluent is withdrawn by a line 24 and heat exchanged against the incoming feed in exchanger 14. A line 26 carries the partially cooled hydrotreater effluent from exchanger 14 to a cooler 28. A line 30 carries the cooled hydrotreater effluent from the exchanger 28 to a separator 32. Hydrogen, light hydrocarbon gases, and some $H_2S$ are withdrawn overhead from separator 32 by line 34 while the condensed liquids are carried by line 36 over to an adsorption section 38. The liquid hydrocarbon phase carried by line 36 enters an adsorption column 40 where it contacts an adsorbent material that adsorbs $H_2S$ and water to accomplish $H_2S$ removal and drying. The desulfurized and dried product is recovered by line 42 from adsorption column 40. Once the adsorbent in the adsorbent column has become loaded with $H_2S$ and/or water, it undergoes desorption as shown for an adsorbent column 44. A hydrogen regeneration gas is heated in an exchanger 46 and carried by a line 48 into adsorption column 44. Water, $H_2S$ and regeneration gas are taken from adsorption column 44 by line 50, cooled in cooler 52 and removed from the process. Circulation of regeneration gas through adsorption column 44 continues until there is an essentially complete removal of $H_2S$ and water from the adsorbent material contained therein. A more complete description of feed components, product components and the conditions in the operational zones are hereinafter described.

The feeds that will benefit from this process will contain sulfur and in many cases oxygen compounds which will interfere with downstream operations. Sulfur contaminants are present with the original crude oil fraction and include mercaptans, sulfides, disulfides and thiophenes. In the light straight-run feeds, sulfur concentrations will usually range from 20 to 300 ppm. Although light straight-run feeds generally contain few naturally occurring oxygenate compounds, contaminations from other process can introduce significant amounts of oxygenate compounds such as alcohols, ethers, aldehydes and ketones in feedstocks. These oxygenate contaminants can also be removed by the hydrotreatment process herein disclosed.

The feedstock is first mixed with a hydrogen-containing gas stream. Preferably, the gas stream will contain at least 50 wt. % hydrogen. More preferably, the hydrogen-containing gas stream will have a concentration greater than 75 wt. % hydrogen. Hydrogen-producing processes from which the gas stream is obtained can contain relatively large amounts of light hydrocarbons. These light hydrocarbons are undesirable since their presence can increase the loss of product in downstream separation facilities and increases the mass volume through downstream processes. Therefore, hydrogen-containing gas streams of relatively pure hydrogen are preferred.

The feedstocks that can be used in this invention include hydrocarbon fractions rich in $C_4$–$C_7$ paraffins. The term "rich" is defined to mean a stream having more than 50% of the mentioned component. Preferred feedstocks are substantially pure paraffin streams having from 4 to 6 carbon atoms or a mixture of such substantially pure paraffins. Other useful feedstocks include light natural gasoline, light straight-run naphtha, light raffinates, light reformate, light hydrocarbons, field butanes, and straight-run distillates having distillation end points of about 170° F. (77° C.) and containing substantial quantities of $C_4$–$C_6$ paraffins. The feedstream may also contain low concentrations of unsaturated hydrocarbons and hydrocarbons having more than 7 carbon atoms.

The gas stream is mixed with the feed in proportions that will produce a hydrogen to hydrocarbon ratio of not more than 50 SCFB (8.8 $stdm^3/m^3$). The hydrotreatment zone of this invention can be operated with hydrogen concentrations as low as 10 SCFB (1.8 $stdm^3/m^3$). A hydrogen concentration of 10 SCFB (1.8 $stdm^3/m^3$) provides hydrogen for chemical demands which, require very small amounts of hydrogen for the desulfurization and deoxygenation reactions, and sufficient hydrogen partial pressure to drive the reaction. Hydrogen concentrations above 50 SCFB (8.8 $stdm^3/m^3$) in the reaction zone interfere with the economical operation of the process.

The feed is heated and then enters a hydrotreatment reactor. Conditions within the reaction zone typically include a temperature in the range of 390°–650° F. (200°–350° C.), a pressure of from 100 to 800 kPa and a liquid hourly space velocity of from 1 to 20. Typically, the reaction conditions are selected to keep the hydrocarbon feed in a vapor phase.

The hydrotreatment reactor contains a fixed bed of hydrotreatment catalyst. Catalytic composites that can be used in this process include traditional hydrotreating catalysts. Combinations of clay and alumina-containing metallic elements from both Group VIII and Group VIB of the Periodic Table have been found to be particularly useful. Group VIII elements include iron, cobalt, nickel, ruthenium, rhenium, palladium, osmium, indium and platinum with cobalt and nickel being particularly preferred. The Group VIB metals consist of chromium, molybdenum and tungsten, with molybdenum and tungsten being particularly preferred. The metallic components are supported on a porous carrier material. The carrier material may comprise alumina, clay or silica. Particularly useful catalysts are those containing a combination of cobalt or nickel metals from 2 to 5 wt. % and from 5 to 15 wt. % molybdenum on an alumina support. The weight percentages of the metals are calculated as though they existed in the metallic state. Typical commercial catalyst comprise spherical or extruded alumina based composites impregnated with Co-Mo or Ni-Mo in the proportions suggested above. The ABD of commercial catalysts generally range from 0.5 to 0.9 g/cc with surface areas ranging from 150 to 250 $m^2/g$. Generally, the higher the metals content on the catalyst, the more active the catalyst.

Effluent from the hydrotreatment reactor enters one or more stages of cooling to condense most of the vapor product into a liquid phase product stream. The concentration of hydrogen in the effluent from the hydrotreater will usually be on the order of 4 mol. % and preferably will have a hydrogen concentration of 2 mol. %. Conversion of the sulfur in the hydrotreater zone will be approximately 99.9% such that essentially all the sulfur has now been converted to $H_2S$. For this purpose, the effluent from the hydrotreatment reactor will be cooled to a temperature of from 550° to 100° F. This cooling will cause a large portion of the $H_2S$ and hydrogen to be absorbed in the liquid phase of the hydrotreatment effluent. In one form of this invention, the hydrogen concentration is low enough to condense essentially all of the effluent from the hydrotreatment reactor. In these cases there will be an essentially liquid phase hydrotreatment effluent stream that can be passed directly to an adsorption section for the removal of $H_2S$ and other contaminants. In most cases, however, cooling of the hydrotreatment effluent will still leave a vapor phase portion that will consist primarily of hydrogen, $H_2S$, light hydrocarbons, and possibly water as well as other contaminants. The hydrocarbons in the gaseous phase will be light gases that can include $C_1$–$C_3$ hydrocarbons which may have entered with the feed or were produced by a minor degree of hydrocracking. The majority of the $H_2S$ leaving the hydrotreater reactor will be in the liquid phase of the cooled hydrotreater effluent. Although equilibrium favors a relatively higher concentration of $H_2S$ in the gaseous phase, the proportion of liquid to vapor in the effluent is very high so that the majority of the $H_2S$ is in the liquid phase.

Where there is a substantial vapor phase, the cooled hydrotreater effluent will enter a separation zone. The separation zone divides the hydrogen and light gases from the liquid phase. Preferably, the separation zone will consist of a simple flash drum. The main purpose of the flash removal section is to remove light ends and any hydrogen. The flash separator is usually operated at a pressure in a range of from 250 to 450 psig. Since the $H_2S$ is removed by adsorption in later stages, the only function of the flash separator is the removal of the hydrogen and light ends to obtain a liquid phase, hydrocarbon stream for adsorption. Since the amount of hydrogen entering the separation is low, there is only a small amount of hydrogen and light gases that are removed overhead from the separator. The low volume of hydrogen and other gases going overhead from the separator limits the loss of higher hydrocarbons such as $C_4$'s.

The adsorption section receives an essentially liquid phase stream either directly from the hydrotreater effluent coolers or from the separation section. In this invention, the primary function of the adsorption section is to adsorb $H_2S$ and thereby eliminate the stripper that was otherwise needed in the separation section of prior art hydrotreater separation sections. Without the stripper section, there is very little loss of $C_4$ hydrocarbons and essentially no loss of $C_5$ and higher hydrocarbons from the liquid phase of the hydrotreater effluent. The adsorption section, in most cases, will also be designed to adsorb water as well as $H_2S$. In most applications of this process, an adsorption section would normally be present anyway for the removal of water so that all that is needed is the addition of additional capacity for the removal of $H_2S$. As a result, the use of an adsorption section to remove $H_2S$ poses only minor increases in the cost of the separation section. In fact, the removal of $H_2S$ from the adsorption section may not impose any penalty on the operation of adsorption driers. A typical adsorbent for drying, such as a 4 A type molecular sieve, has a greater selectivity for water than $H_2S$. Since water first is adsorbed, the extra adsorbent for the removal of $H_2S$ provides an extended mass transfer zone for reducing the residual concentration of water that will leave the adsorption section. Since downstream processes, such as isomerization, are usually more sensitive to water, additional adsorbent provides the benefit of insuring that water concentrations are low.

This invention does not require the use of any particular adsorbent material. Any adsorbent that has a high capacity and selectivity for $H_2S$ will be suitable for the use of this invention in its most basic form. Preferred adsorbents for this invention consist of molecular sieve adsorbents with a pore size below 4 angstroms and above 3.6 angstroms, and more specifically adsorbents such as sodium A and clinoptilolite are representative samples of suitable adsorbents. Typically, the adsorbent material will also have a capacity for water removal. Preferred adsorbents for $H_2S$ and water removal are 4 A type sieves.

In a preferred form, the adsorbent material is readily regenerable and the adsorption zone is designed for the regeneration of the adsorbent material. Adsorption systems using two or more regeneration columns such that one adsorption column is used for the adsorption while another column is in one or more stages of regeneration are well known to those skilled in the art. In most process arrangements for this invention, the adsorption material will be regenerated using a regeneration gas in a multiple bed adsorption system. Suitable regeneration gases for this purpose will include hydrogen and hydrocarbon streams. The figure shows a typical regeneration system where a regeneration gas is heated to a temperature in a range of 450°-600° F. and passed through a regeneration zone to desorb hydrogen sulfide and water from the adsorbent material. Pressure in the adsorption column is usually reduced to about 100 psi or less in order to increase desorption. The adsorption stream leaving the adsorption column is further cooled to a temperature of between 80° to 100° F.

The desorbent stream can undergo further separation for the removal of $H_2S$ and, when present, water from the regeneration gas for its reuse in the desorption stage. However, in most cases, the desorbent stream will not be recycled directly to the adsorption section. Where a hydrocarbon stream is used as the desorbent, the $H_2S$ loaded stream may be passed to the separation facilities for another process. For example, the hydrocarbon desorbent stream can be passed to the crude unit of a refinery where $H_2S$ and water can be removed and the rest of the hydrocarbon stream is recycled. Alternately, the desorbent stream can be passed to a gas treatment facilities such as an FCC gas concentration section. The relatively low volume of the desorbent material makes it possible to handle this stream in a variety of ways which will be readily appreciated by those skilled in the art.

EXAMPLE

The following example is provided to show the operation of the hydrotreatment system of this invention. This example is based on engineering calculations and actual operating experience from similar components and other hydrotreatment and adsorption processes.

| LINE NO. | 10 Fresh Feed | 24 Reactor Effluent | 12 Once-Thru Hydrogen | 34 Vent | 36 Adsorber Feed | 42 Product |
|---|---|---|---|---|---|---|
| COMPONENTS LBS/HR | | | | | | |
| WATER | 8 | 8 | — | 1 | 7 | — |
| HYDROGEN SULFIDE | — | 21 | — | 1 | 20 | — |
| PROPYLMERCAPTAN | 45 | — | — | — | — | — |
| HYDROGEN | — | 54 | 55 | 30 | 25 | 25 |
| METHANE | — | 10 | 10 | 2 | 8 | 8 |
| ETHANE | — | 18 | 18 | 1 | 17 | 17 |
| PROPANE | — | 42 | 16 | 1 | 42 | 42 |
| I-BUTANE | 10 | 14 | 4 | — | 14 | 14 |
| N-BUTANE | 447 | 453 | 6 | 2 | 451 | 451 |
| I-PENTANE | 6730 | 6733 | 3 | 11 | 6722 | 6722 |
| N-PENTANE | 12032 | 12034 | 2 | 15 | 12018 | 12018 |
| CYCLOPENTANE | 1161 | 1161 | — | 1 | 1160 | 1160 |
| 2,2-DIMETHYLBUTANE | 181 | 181 | — | — | 181 | 181 |
| 2,3-DIMETHYLBUTANE | 590 | 590 | — | — | 590 | 590 |
| 2-METHYLPENTANE | 5331 | 5343 | 12 | 3 | 5340 | 5340 |
| 3-METHYLPENTANE | 3346 | 3346 | — | 2 | 3344 | 3344 |

-continued

| LINE NO. | 10 Fresh Feed | 24 Reactor Effluent | 12 Once-Thru Hydrogen | 34 Vent | 36 Adsorber Feed | 42 Product |
|---|---|---|---|---|---|---|
| N-HEXANE | 9895 | 9895 | — | 4 | 9891 | 9891 |
| METHYLCYCLO-PENTANE | 4464 | 4464 | — | 2 | 4462 | 4462 |
| CYCLOHEXANE | 1709 | 1709 | — | 1 | 1708 | 1708 |
| BENZENE | 519 | 519 | — | — | 519 | 519 |
| 2-METHYLHEXANE | 1180 | 1180 | — | — | 1180 | 1180 |
| TOTAL | 47648 | 47775 | 127 | 76 | 47700 | 47673 |

Referring again to FIG. 1, a feed having a composition given in the Table for line 10 is admixed with a hydrogen-containing stream. The hydrogen stream contains primarily hydrogen and light gases as described in the Table for line 12. The feed and hydrogen are first heated in exchanger 14 to a temperature of about 475° F. and then further heated in heater 18 to a temperature of 550° F. The heated feed and hydrogen mixture enters the hydrogen reactor at a pressure of 360 psig. The hydrotreater reactor contains a commercial cobalt-molybdenum type hydrotreatment catalyst that the feed contacts at a weight hourly space velocity of 8. The hydrotreater effluent recovered from the hydrotreater reactor has the composition given in the Table for line 24. Passage of the feed through the hydrotreater achieves an essentially complete conversion of sulfur-containing compounds to $H_2S$. The hydrotreater effluent is cooled in heat exchangers in exchanger 14 and 28 to a temperature of 100° F. In flash drum 32, the cooled hydrotreater effluent is separated into an overhead vent stream having the composition given for line 34 in the table and a liquid stream having a composition given for line 36. The separator liquid is passed to an adsorption column containing approximately 3500/lbs of a 4 A type adsorbent and passed through the column at a temperature of 100° F. and a pressure of 350 psig. A dried and sulfur-free product stream having a composition given in the table under line 42 is removed from the adsorbent column. While the separator liquid passes through one of the adsorber vessels, another adsorber vessel is regenerated in a series of regeneration steps. These regeneration steps include a desorption step wherein a $C_5$–$C_6$ stream from an isomerization zone is passed through the adsorber vessel at a rate of about 2550 lbs/hr. for approximately 5 hours at a temperature of about 550° F. and a pressure of about 100 psig. The adsorber cycles on about 8 hour intervals.

What is claimed is:

1. A process for treating a sulfurous hydrocarbon stream comprising $C_4$ and larger hydrocarbons and containing a sulfur concentration of at least 20 ppm to convert sulfur compounds to $H_2S$ and reduce the sulfur concentration of said hydrocarbon stream, said process comprising:

a) admixing said sulfurous hydrocarbon feedstream with a hydrogen stream in a ratio of less than 50 SCFB;

b) contacting said sulfurous hydrocarbon stream and said hydrogen in a hydrotreating zone with a hydrotreating catalyst at hydrotreating conditions to convert sulfur compounds to $H_2S$ and produce a hydrotreated effluent stream;

c) passing said hydrotreated effluent feedstream to a flash separator at conditions that will maintain a liquid phase containing at least 75 wt. % of said $H_2S$ and removing hydrogen from said hydrotreated effluent to produce an at least partially stabilized effluent;

d) passing said partially stabilized effluent at liquid phase conditions to an adsorption section and contacting said stabilized effluent with an adsorbent material selective for $H_2S$ to adsorb $H_2S$ from said effluent stream;

e) recovering a desulfurized hydrocarbon stream from said adsorption section;

f) passing a regeneration gas to said adsorption section and contacting said adsorbent material with said regeneration gas to desorb $H_2S$ from said adsorbent material; and, g) removing regeneration gas containing $H_2S$ from said process.

2. The process of claim 1 wherein the feedstream comprises $C_4$–$C_{10}$ hydrocarbons.

3. The process of claim 1 wherein the hydrogen concentration of the hydrocarbon stream and hydrogen entering said hydrotreating zone is in a range of from 10 to 40 SCFB.

4. The process of claim 1 wherein said hydrotreating catalyst comprises cobalt and molybdenum on an alumina support.

5. The process of claim 1 wherein said hydrotreating zone operates at a temperature of from 390°–650° F. and a pressure of from 100 to 800 psig.

6. The process of claim 1 wherein said hydrotreating zone converts essentially all sulfur compounds to $H_2S$.

7. The process of claim 1 wherein said hydrotreated effluent stream is cooled to a temperature in the range of from 80°–150° F. and passed directly from said hydrotreating zone to a flash drum to flash hydrogen and $H_2S$ from said hydrotreated effluent stream.

8. The process of claim 1 wherein said adsorbent is selected from the group consisting of a sodium-exchanged type 4 A zeolite.

9. The process of claim 1 wherein said process removes $H_2O$ from said hydrotreated feed effluent and said adsorbent comprises a molecular sieve having a greater selectivity for $H_2O$ than for $H_2S$.

10. The process of claim 9 wherein said adsorbent is a type 4 A molecular sieve.

11. A process for treating a sulfurous hydrocarbon stream comprising $C_4$ and larger hydrocarbons and containing a sulfur concentration of at least 20 ppm to convert sulfur compounds to $H_2S$ and reduce the sulfur concentration of said hydrocarbon stream, said process comprising:

a) admixing said sulfurous hydrocarbon feedstream with a hydrogen stream in an amount that will produce a hydrogen to hydrocarbon ratio of less than 50 SCFB;

b) contacting said sulfurous hydrocarbon stream and said hydrogen in a hydrotreating zone with a hydrotreating catalyst at hydrotreating conditions to convert sulfur compounds to $H_2S$ and produce a hydrotreated effluent stream;

c) adjusting the amount of said hydrogen that is admixed with said sulfurous hydrocarbon stream to produce a hydrogen to hydrocarbon ratio of less than 4 mol. % in said hydrotreated effluent stream;

d) cooling said hydrotreated effluent stream and absorbing essentially all of said hydrogen into a liquid phase of said hydrotreated effluent stream;

e) passing said hydrotreated effluent from step (d) to an adsorption section and contacting said stabilized effluent with an adsorbent material selective for $H_2S$ to adsorb $H_2S$ form said effluent stream;

f) recovering a desulfurized hydrocarbon stream from said adsorption section;

g) passing a regeneration gas to said adsorption section and contacting said adsorbent material with said regeneration gas to desorb $H_2S$ from said adsorbent material; and, h) removing regeneration gas containing $H_2S$ from said process.

12. The process of claim 11 wherein the hydrogen concentration of the sulfurous hydrocarbon stream and hydrogen entering said hydrotreating section is in a range of from 10 to 40 SCFB.

13. The process of claim 11 wherein said hydrotreating zone operates at a temperature of from 100°-650° F. and a pressure of from 100 to 800 psig.

14. The process of claim 13 wherein said hydrotreated effluent stream has a hydrogen to hydrocarbon ratio of between 10 to 20 SCFB.

15. The process of claim 13 wherein said hydrotreated effluent stream is cooled to a temperature of from 80°-150° F.

16. The process of claim 13 wherein essentially all of said hydrotreated effluent is in liquid phase as it enters said adsorption section.

17. The process of claim 13 wherein said adsorption section removes $H_2O$ and $H_2S$ from said hydrotreated effluent.

* * * * *